US006445772B1

(12) United States Patent
Campbell

(10) Patent No.: US 6,445,772 B1
(45) Date of Patent: Sep. 3, 2002

(54) HIGH PRECISION GRIDS FOR NEUTRON, HARD X-RAY, AND GAMMA-RAY IMAGING SYSTEMS

(75) Inventor: Jonathan W. Campbell, Harvest, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 32 days.

(21) Appl. No.: 09/867,995

(22) Filed: May 30, 2001

(51) Int. Cl.[7] ..... G21K 1/00
(52) U.S. Cl. ..... 378/154; 250/390.1
(58) Field of Search ..... 378/154, 155, 378/150, 43; 250/518.1, 390.1

(56) References Cited

U.S. PATENT DOCUMENTS 5,980,977 A * 11/1999 Deng et al. ..... 427/79
6,028,699 A * 2/2000 Fisher ..... 359/360

* cited by examiner

*Primary Examiner*—David P. Porta
*Assistant Examiner*—Elizabeth Gemmell
(74) *Attorney, Agent, or Firm*—James L. McGroary

(57) ABSTRACT

Fourier telescopes permit observations over a very broad band of energy. They generally include synthetic spatial filtering structures, known as multilayer grids or grid pairs consisting of alternate layers of absorbing and transparent materials depending on whether neutrons or photons are being imaged. For hard x-rays and gamma rays, high (absorbing) and low (transparent) atomic number elements, termed high-Z and low-Z materials may be used. Fabrication of these multilayer grid structures is not without its difficulties. Herein the alternate layers of the high-Z material and the low-Z material are inserted in a polyhedron, transparent to photons of interest, through an open face of the polyhedron. The inserted layers are then uniformly compressed to form a multilayer grid.

12 Claims, 5 Drawing Sheets

HIGH PRECISION GRIDS FOR NEUTRON, HARD X-RAY, AND GAMMA-RAY IMAGING SYSTEMS

CROSS-REFERENCE TO A RELATED APPLICATION

This application is related to my application entitled Rotational-Translational Fourier Imaging System, filed Dec. 30, 1998, and assigned Ser. No. 09/246,193.

STATEMENT REGARDING FEDERALLY-SPONSORED RESEARCH OR DEVELOPMENT

The invention described in this patent was made by an employee of the United States Government and may be manufactured and used by or for the Government for governmental purposes without the payment of any royalties.

BACKGROUND OF THE INVENTION

1. Field of the Invention

This invention, in its broad aspect, relates to neutron, hard X-ray, and gamma ray imaging, and to Fourier imaging instruments therefore. In a more specific aspect, the invention relates to high precision grids or arrays for such imaging instruments. In still another aspect the invention provides a method for the fabrication of such grids.

2. Background Information

During the past three decades, observational astronomy has expanded from the relatively narrow wavelength band of visible light to the entire electromagnetic spectrum. In addition, subatomic particles especially high-energy neutrons form a second spectrum of interest. The impetus for this expansion was the realization that different spectral ranges allow different and complementary insights into cosmic and other natural events as well as enabling images of objects and masses surrounded by ordinarily opaque materials.

X-ray astronomy is a product of the Space Age, enabling observers to cover a band of photon energies between 0.1 keV and 500 keV. Gamma rays have even higher photon energies. The X-ray sky is dominated by active sources such as radio galaxies, Seyfert galaxies, and quasars, which emit X-rays and gamma rays, as well as black holes, and clusters of galaxies that make up the largest physical formations of our universe.

Significantly, phenomena that occur at the end of the stellar lifetimes are observable in our Galaxy and beyond. Such stars as White Dwarf stars, neutron stars and pulsars emit neutrons that can be also be studied. In addition to sources located in the heavens, many terrestrial applications also employ the penetrating characteristics of x-rays, gamma rays, and neutrons. The invention herein is therefore concerned with neutron, hard X-ray, and gamma ray imaging.

Hard X rays, gamma rays, and high energy neutrons cannot be reflected or focused with lenses or mirrors. Impinging at normal incidence on optical materials, they penetrate the optic rather than experiencing the refraction (lenses) or reflection (mirrors) necessary to form an image. Hard X-ray astronomy (20 to 100 keV) and other imaging applications were originally handicapped because of this lack of imaging capability. Further, it was realized that even grazing-incidence reflection, used very effectively in soft X-ray astronomy, is impractical in the photon-energy domain above a few keV. This realization led to the development of Fourier telescopes, one such telescope being the subject of U.S. Pat. No. 5,838,757. Fourier telescopes permit observations over a very broad band of energy from ultraviolet to 100 keV.

Soft X-ray telescopes using multilayers are based on designs that utilize arrays of crystals that are adjusted to diffract photons of a fixed energy to the same point along the optical axis. Crystals have been used to diffract X-rays for years. Their periodic structure makes this possible. Crystal diffraction gratings, however, are not the perfect solution to the X-ray astronomy problem. As pointed out in U.S. Pat. No. 4,675,889 crystalline structures such as lithium fluoride, metal acid phthalates, and pyrolytic graphite have very restrictive lattice spacing constraints, and they must be operated near room temperature in a dry environment. It is noted in U.S. Pat No. 5,646,976 that crystals also possess poor mechanical qualities such as resistance to scratching. For such reasons, as expressed in U.S. Pat. No. 4,675,889, numerous steps have been taken to construct both natural and new crystalline analogue materials. Such attempts have led to synthetic structures, known as multilayers or multilayer coatings, consisting of alternate layers of high and low atomic number elements, termed high-Z and low-Z materials. Multilayer coatings are the subject of such patents as U.S. Pat. No. 4,675,889, U.S. Pat. No. 4,915,463, U.S. Pat. No. 5,042,059, U.S. Pat. No. 5,646,976, U.S. Pat. No. 5,757,882, and U.S. Pat. No. 5,799,056. Referring again to U.S. Pat. No. 5,646,976, in order for a multilayer structure to reflect by imitating a crystal structure, a light element of the lowest possible electron density is layered with a heavy element of the highest possible electron density. This means that fabrication of the multilayer structure is not without its difficulties. The angle of incidence and d spacing must be manipulated according to the Bragg equation.

The coating of optical surfaces without imperfections in d spacing is difficult. In an effort to obviate such difficulties multilayers have been formed by electron beam-physical vapor deposition, laser evaporation, sputtering techniques such as magnetron RF, ion beam and bias sputtering, as well as diode sputtering, reactive gas injection and the standard multisource evaporation process disclosed in U.S. Pat. No. 4,675,889. These methods, while solving the problem, have been costly and time consuming. They have rendered the multilayers one of the more expensive elements of an imaging system.

Many of these same methods have been attempted for hard x-ray, gamma ray, and neutron imaging systems with the same prohibitive costs being realized. This and other disadvantages have led to other approaches such as milling and etching, and the placement of thousands of tiny slats into pre-machined slots in telescope grid trays. Fabricators have even attempted to place each single slat, or layer, in place by hand in a frame in lay-up fashion Typically such methods have been very time consuming, and they have been disadvantageous from a performance standpoint. By the practice of this invention the difficulties and expense of deposition coatings to produce multilayer grids are overcome, as well as problems encountered in the undesirable slat hand-fabrication method.

An object of the invention is to provide a low cost approach for fabricating grids, while retaining or improving performance.

Another object is the provision of grids and a method of fabricating grids for use in Fourier Imaging Systems in any configuration required by the imaging system.

Still another object of the invention is the provision of a method that greatly reduces grid fabrication times.

SUMMARY OF THE INVENTION

Imaging information has frequently been collected using multiple grids mounted in grid trays within telescopes and other optical instruments used for neutron, hard X-ray and gamma-ray imaging. By this invention multilayer grids are provided for telescopes carrying grid trays having openings to receive such multilayer grids. A polyhedron is fabricated with two larger faces in the form of congruent polygons that form front and back surfaces so sized that the resulting polyhedron fits slidably within a grid tray opening. Smaller polygonal faces separate the front and back surfaces, forming a polyhedral grid case. All of the polyhedral faces are transparent to photons of interest. For x-rays and gamma rays, alternate layers of a high-Z material and a low-Z material are then inserted in the polyhedron, through an open face of the polyhedron. The layers of high-Z and low-Z materials are so sized that their widths are equal to the width of the polyhedron between the front and back faces. The inserted layers are then uniformly compressed to form a multilayer grid. Desirably the compressing operation is accomplished by the use of one or more pistons. For neutron imaging, alternating layers of beryllium and glass may be used respectively. In all cases, the idea is to alternate materials that are opaque/absorptive and transparent to the selected photon or particle.

DESCRIPTION OF THE INVENTION

This invention provides a grid system that normally includes grids arranged in a grid array that can be rotated to produce components in a Fourier transform to synthesize an image of an object being viewed. The imaging methods are applicable to various energies of penetrating radiation, and they are particularly suitable for neutrons, hard X-rays, and gamma rays for which there are no other effective imaging methods. With the understanding that the thicknesses of the multilayers are overemphasized for the purpose of clarification the invention it will now be described in conjunction with drawings of some of its embodiments as well as of a preferred embodiment.

DESCRIPTION OF PREFERRED EMBODIMENTS

Figure 1:
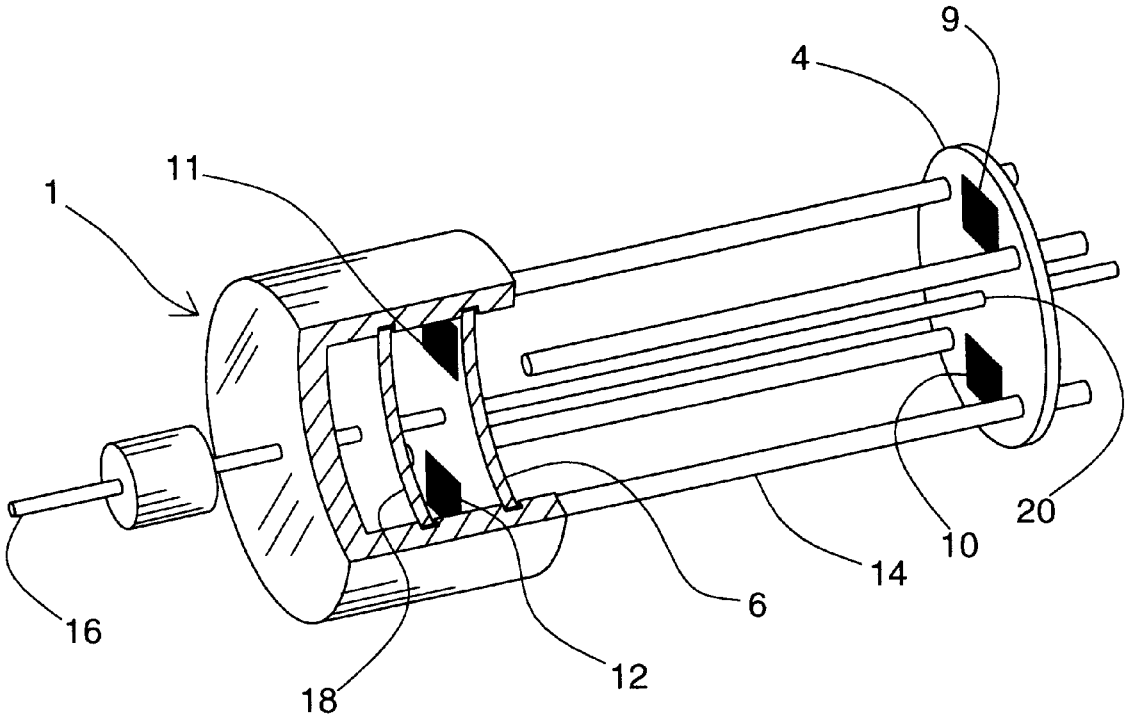
FIG. 1 is a simplified isometric view with cut-away portions showing a preferred imagining system in which the grids of the invention will be incorporated.

Prior to describing how the grids of this invention are fabricated, it will be helpful to understand how the grids herein are best used. Desirable imaging instruments are those provided with grid trays for inclusion of the grids. A preferred instrument using grid trays is an imaging system 1 illustrated in FIG. 1. Two grid trays 4 and 6 are included, each having a pair of openings, one pair to receive grids 9 and 10, and one pair to accept grids 11 and 12. As described in my copending application referred to hereinbefore these two grid pairs provide the same imaging information that has been traditionally collected with multiple grid pairs. The first grid tray 4 has a real grid 9 and an imaginary grid 10. The second grid tray 6 is connected to the first grid tray 4 by one or more connecting rods 14 so that real grid 9 is aligned with real grid 11 and imaginary grid 10 is aligned with imaginary grid 12. Through drive rod 16 the grids are rotated so that data can be collected by detector 18 at multiple angular grid positions. The assembled grids, acting one behind the other, serve to allow only one spatial frequency from a source to pass through to a detector such as 18.

Figure 2:
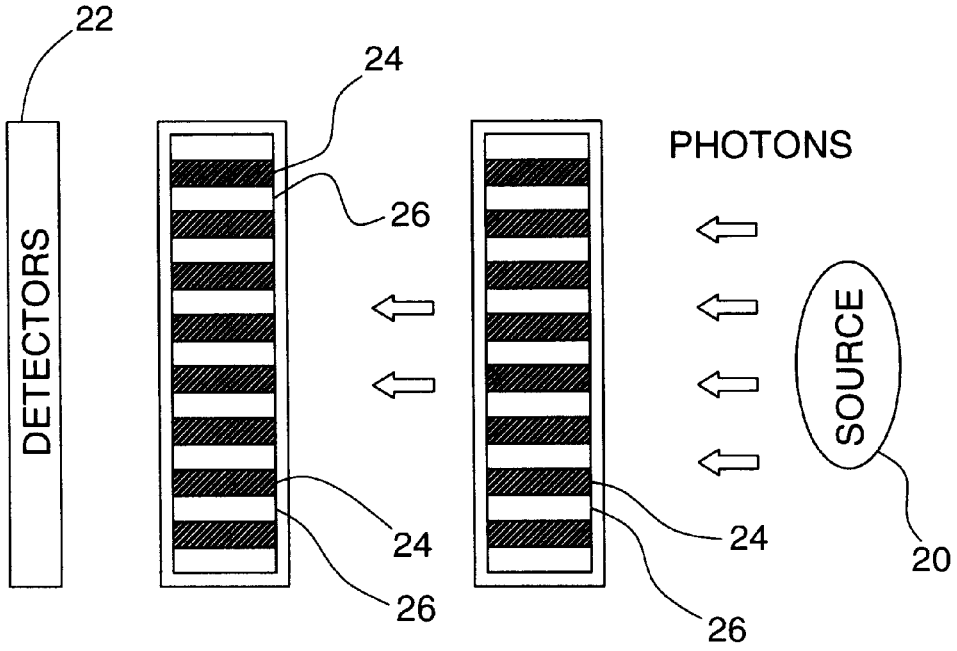
FIG. 2 is a schematic view illustrating the theory of the telescope shown in FIG. 1.

A schematic representation of this imaging device is illustrated in FIG. 2 showing the energy source 20 (either X-rays, gamma rays or neutrons), two grids, such as 9 and 11 in FIG. 1, and detector 22. In the grid of this invention, element 24 is an opaque/absorbing material and element 26 is a transparent material. In general, depending on the selection of penetrating radiations, alternating layers of opaque/absorbing and transparent materials are used. It is the fabrication of these grid structures with which this invention is concerned. The stack can have any arbitrary number of layers such as 24 and 26, up to, say, ninety-nine, and the thickness of the layers usually ranges from the unit of nanometers to the unit of micrometers. Clearly, then, in the figures herein, the structures are exaggerated for clarification. Further, the resolution of the imaging system is limited by the thickness of the layers. In the embodiment preferred herein for X-rays and Gamma Rays, the opaque/absorptive element is tungsten and the transparent element is aluminum, although other absorptive and transparent materials for multilayers are well known in the art and need not be discussed at length herein. Examples are the preferred Al and W, as well as Si, Mo, Ti, Ni, Ag, C, ITO, Nb, Sr. In addition metal oxides such as $Al_2O_3$, $Y_2O_3$, $TiO_2$, and the like, can be used. W/Si, NiC, and Mo/Si layers have been found useful, particularly in solar physics and EUV lithography. Transparent and absorbing materials such as beryllium, and glass for neutrons are also well known in the art and need not be revisited at length herein.

Figure 3:
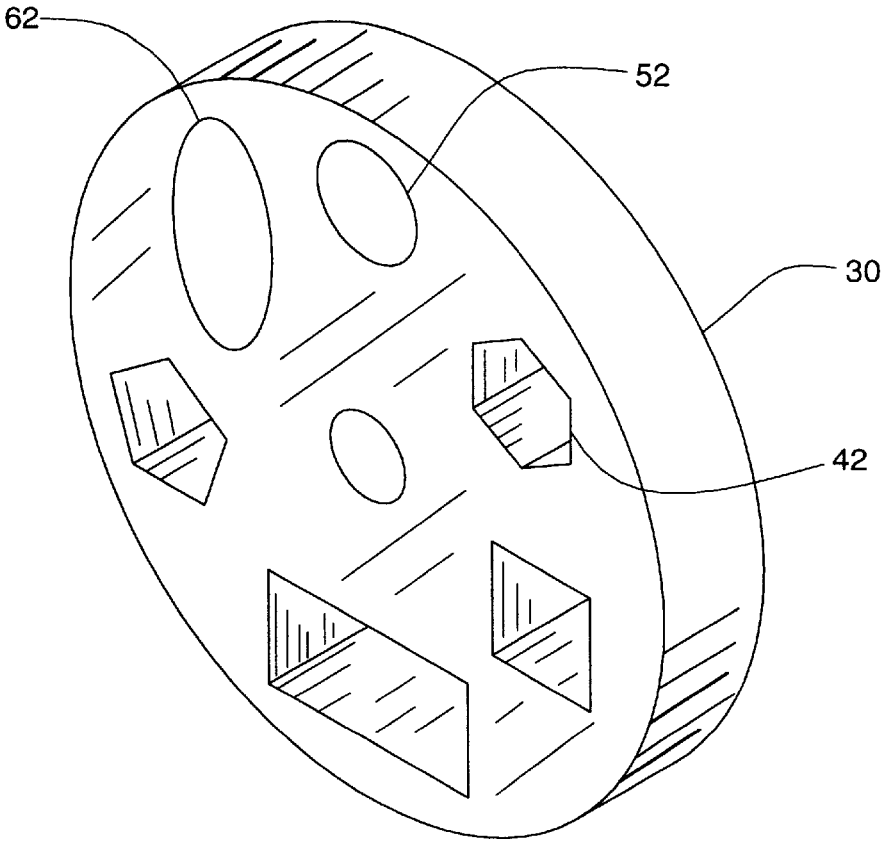
FIG. 3 is an isometric view of a grid tray showing openings for the grids of the invention, and for other instruments utilized in space exploration.

Since multiple spatial frequencies are required to form an image, several grids are usually considered to be essential. The preferred means for utilizing more than one grid is the provision of grid trays carrying multiple grids. However, the openings in the grid trays into which the grids are placed are not always square apertures like those in FIG. 1. Rather, openings for the grids are fabricated in various shapes, which can be hexagonal, octagonal, round, and ellipse-shaped. FIG. 3 shows a typical grid tray 30 with openings for various sizes of grids and other instrumental elements. It is noted that such grid trays are to accept instruments having small round cross sections, as well as larger round cross sections, square and rectangular cross sections, and those having various other shapes. By this invention a method is provided by which grids can readily be made in all of those shapes.

Figure 6:
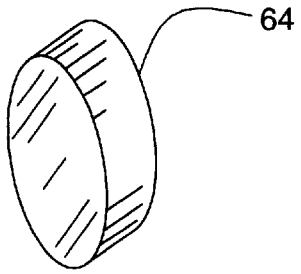
FIG. 6 shows an elliptical grid fabricated for insertion in a grid opening illustrated in FIG. 3.
Figure 4:
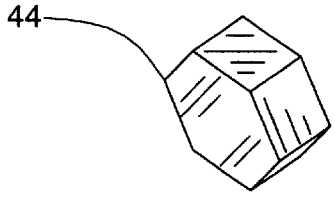
FIG. 4 shows an octagonal polyhedron (octahedron) fabricated for insertion in a grid opening illustrated in FIG. 3.
Figure 5:
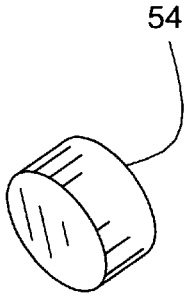
FIG. 5 shows a cylindrical polyhedron fabricated for insertion in a grid opening illustrated in FIG. 3.

In general, the cross sections of openings in grid trays can be considered to be polygons. Since the grids must fit in these polygons, the grid cases, normally referred to as grids, will be polyhedrons with corresponding cross sections. In geometrical terms the cross sections of the grid openings, and the cross sections of the grids are congruent, and the polyhedrons are regular polyhedrons fitting slidably in the grid openings provided for them, a regular polyhedron being defined herein as a polyhedron whose faces between its front and back panels are parallelograms with perpendicular sides. Included are polyhedrons whose front and rear faces are tetragons, hexagons, octagons, decagons, and the like. As examples, three different grid tray openings 42, 52 and 62 are illustrated in grid tray 30 in FIG. 3. In FIGS. 4, 5 and 6 grids 44, 54, and 64 fitting slidably in openings 42, 52, and 62 are illustrated. It can be seen that grids 44, 54 and 64 are polyhedrons in the form of octahedral grids, cylindrical grids and elliptical grids, with the understanding that as the number of sides of a polygon increase it approaches a circle. Accordingly grids can have circular cross sections. Even openings 62 having approximately elliptical cross sections such as those in FIG. 3 are within the purview of this invention since, by the process provided herein, any shaped grid can be made.

In the light of the description of the various shapes of the regular polyhedrons that can be constructed by this invention, the fabrication of the grids can now be described. Preliminarily, it should be pointed out that the polyhedron will be constructed using a transparent material such as aluminum that can be the same as the material in the multilayer within the polyhedron. However for various reasons, including ease of fabrication, glass is preferred herein. Thermally formed glass, being transparent to the particles or photons being observed, has many desirable properties. It results in a superior polyhedron for inclusion therein of the layers forming the multilayer. It is possible to obtain better absorption and scattering performance with glass than with most transparent materials, and it can be fabricated in appropriate sizes.

Figure 7:
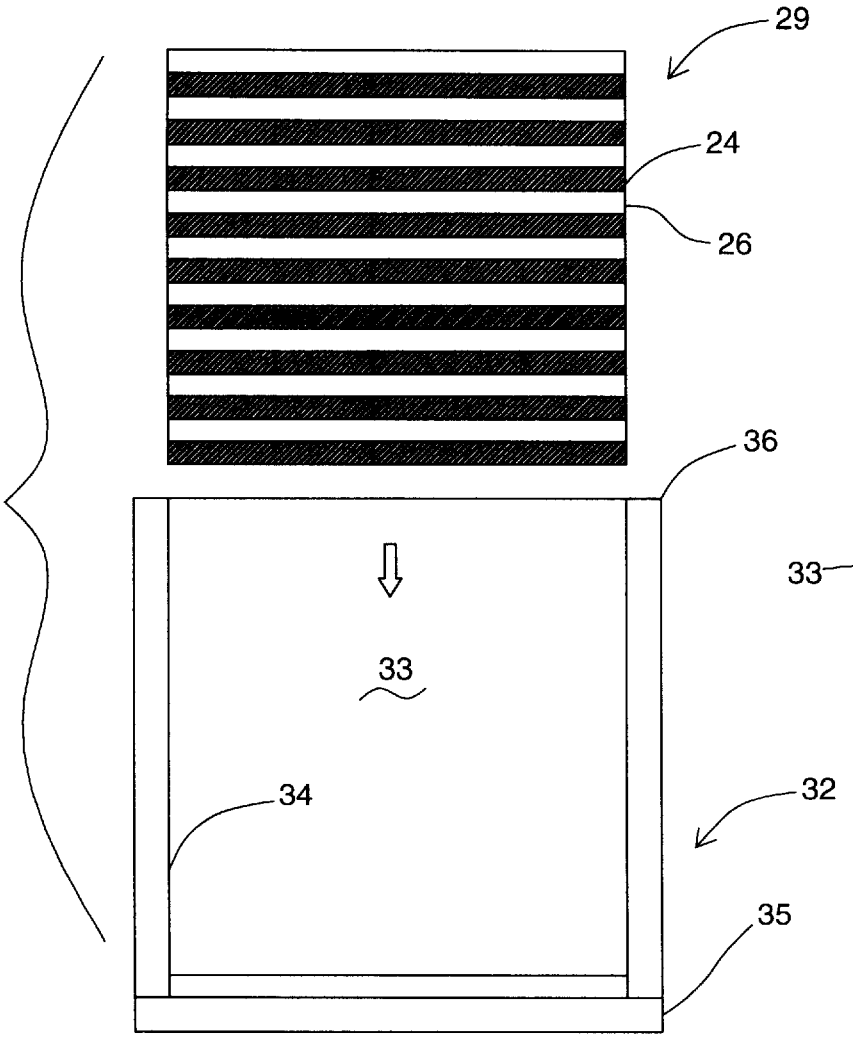
FIG. 7 is a simplified exploded view illustrating the insertion of multilayers according to the invention.
Figure 8:
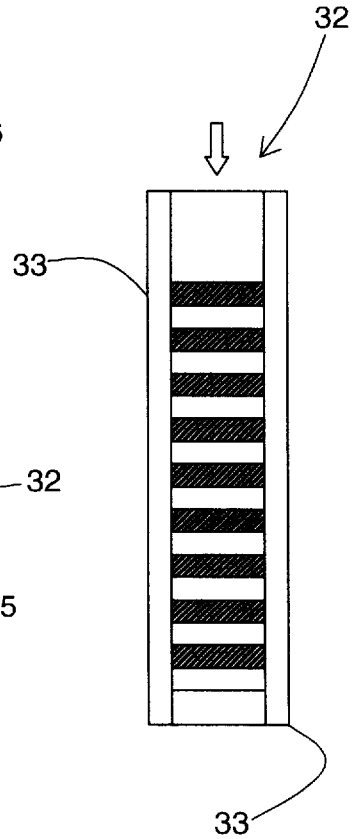
FIG. 8 is an end view of the hexahedron of FIG. 7 to render more clear the insertion method.

For the sake of clarity, the simplest form, and a preferred form, of polyhedron, an elongated hexahedron, will be selected for the purpose of illustration. FIG. 7 is a front view of a hexahedron, 32, showing one of its two elongated parallel faces 33, forming front panel, the parallel back grid panel not being visible. Also only three of its four shorter faces, all of which are perpendicular to each other to form the hexahedron, are illustrated in FIG. 7. These short faces are 34, 35, and 36. The fourth face, a top face, has been removed in order to fabricate the grid. After the polyhedron is assembled, one face, in this instance the top face, is removed for insertion of absorptive and transparent strips or slats 24 and 26 as shown in FIG. 7. Absorptive strips 24, say tungsten, and transparent strips 26, such as aluminum, are sized to acceptable tolerances and cut in lengths equal to the width of the opening in case 32 as can be discerned by comparing FIGS. 7 and 9, FIG. 8 being an end view of hexahedron 32. The narrow bands 24 and 26 are then carefully inserted in hexahedron 32 as alternate layers as can be discerned from FIGS. 7 and 8. After insertion the layers are compressed to achieve a high precision layer alignment.

Figure 9:
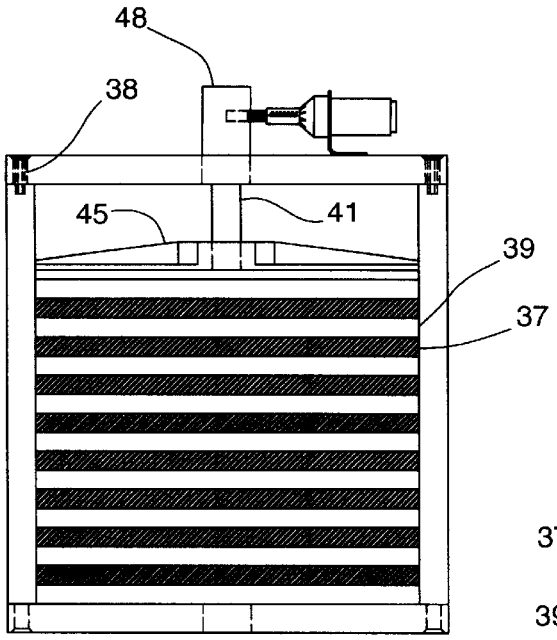
FIG. 9 is a front view of a grid of the invention showing a compression plate and a right angle piston drive.
Figure 11:
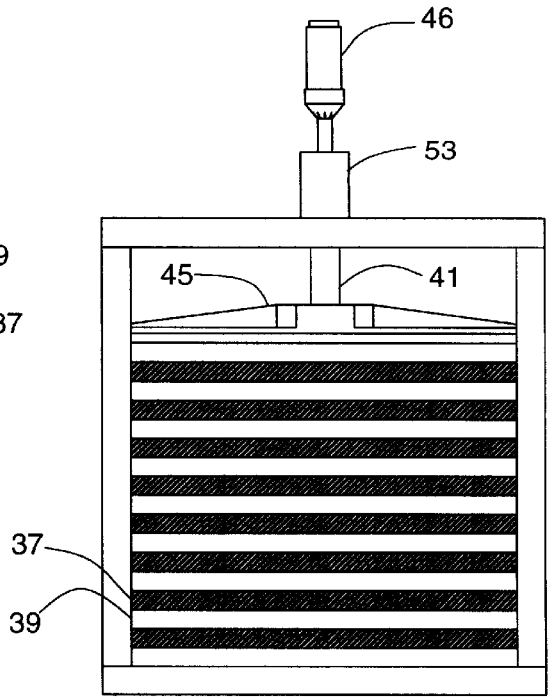
FIG. 11 is a front view of a grid of the invention showing a compression plate and a parallel piston drive.
Figure 10:
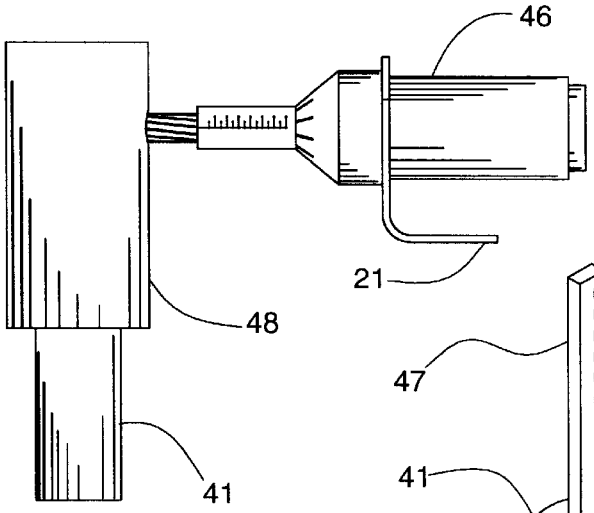
FIGS. 10 and 12 are enlarged views of the piston drive.
Figure 12:
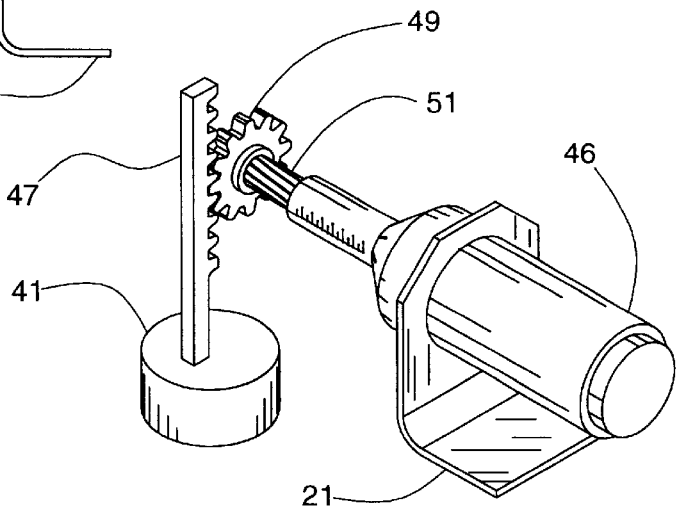

In our preferred embodiment a piston drive is provided, connected as illustrated in FIG. 9, for achieving the proper compression. For greater precision it is used in combination with a micrometer, supported by bracket 21, as shown as an enlargement in FIG. 10. Illustrated in FIG. 10 is casing 48 housing a piston drive. Prior to describing the operation of the piston drive it is to be emphasized again that the mechanisms used, the movement of the piston, the sizes of the polyhedrons, and tolerances are all overemphasized in the drawings herein. The piston moves a fraction of a millimeter, and the drive mechanisms to be depicted are akin to watch works. For this reason a micrometer drive is employed. It can be coupled to a piston drive element, or it can be adapted for use as a wrench or screwdriver. High precision micrometers are provided with spring loaded ratchets limiting the amount of torque applied when measuring. It is this torque feature that makes it possible to achieve uniform piston compression from fabricated grid to fabricated grid The piston drive mechanisms are not a part of this invention since various drives are possible selections. However, as illustrations, two piston driving devices will be described in conjunction with FIGS. 9 and 11. With the understanding that micrometer 46 provides the driving force, FIGS. 9 and 11 illustrate right angle drives and parallel shaft drives respectively. In FIG. 9 the right angle drive is shown. The gear drive within housing 48, which is a rack, is shown in FIG. 12. When micrometer 46, coupled with a spur gear 49 through a spline or other drive rod 51, is turned, the spur gear is rotated. Spur gear 49 then drives rack 47. Since the rack is connected to piston 41, the micrometer drives the piston to the limit of the applied torque. Concomitantly piston 41 urges compression plate 45 downward in order to uniformly compress layers 37 and 39.

In the embodiment of FIG. 11 a miniature screw jack 53 is urged forward by micrometer 46 coupled thereto, and the screw engages, or is coupled to, a piston 41. In this embodiment the drive is a straight gear thus adapted to drive compression or pressure plate 45.

Figure 13:
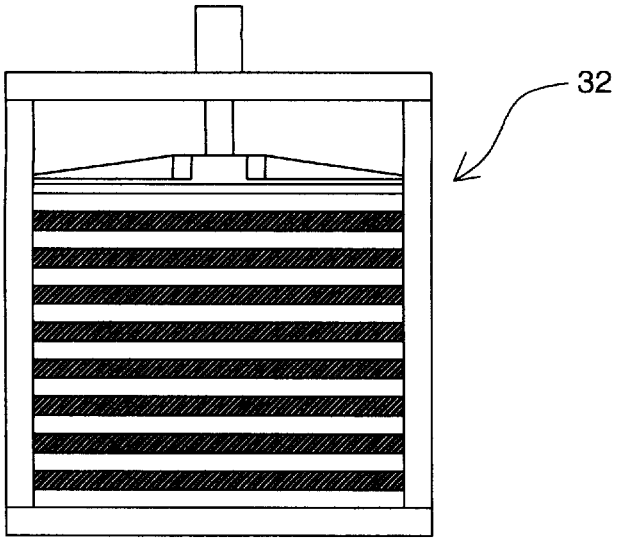
FIGS. 13 and 14 illustrate a different embodiment of the invention wherein the front polyhedral face is in the form of a lid for the grid.
Figure 14:
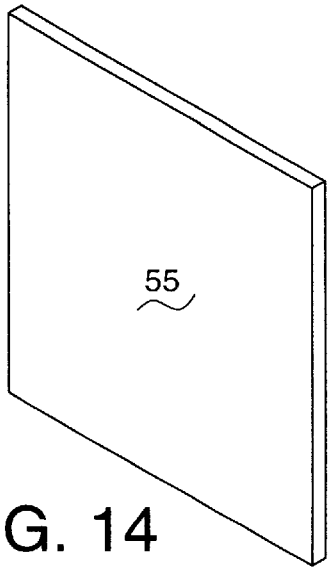
Figure 15:
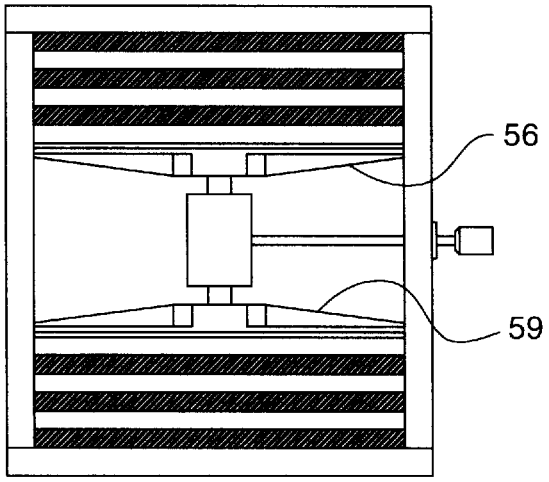
FIGS. 15 and 16 are views of grids illustrating multilayer configurations for use with all grid shapes.
Figure 16:
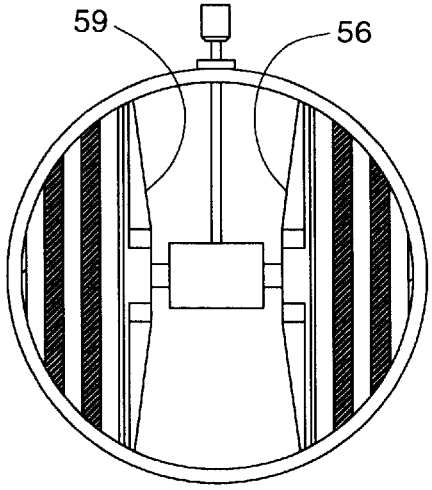
Figure 17:
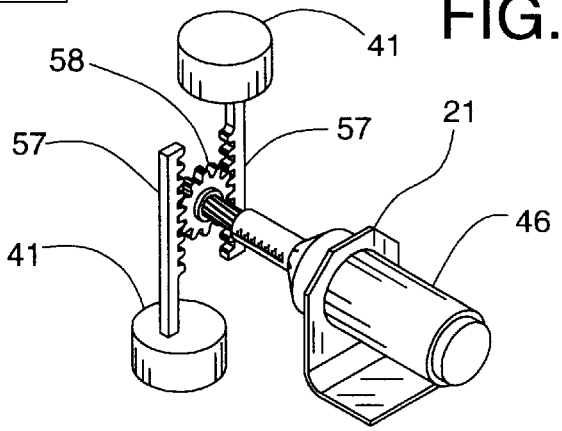
FIG. 17 is an enlarged view of a piston drive adapted for use with the embodiment of FIGS. 15 and 16.

Referring again to FIG. 9, it is noted that the in order for the piston to function the open face must be replaced and locked on by some locking device such as screws 38 or clips, screws being preferred in view of the slidable fit in the grid tray. In addition the method described for producing grids in the form of hexahedrons is not entirely suitable for use in the fabrication of other polyhedral grids. It would be difficult to insert the absorptive and transparent grid layers through an end faces of other polyhedrons such as those previously discussed, and even more difficult to install the piston drives. For such grid shapes it is preferred to construct the front face in the form of an overlapping lid 55 as can be seen by comparing FIGS. 13 and 14. In order to close the polyhedron, the shape of the lid will be that of the polyhedron front face regardless of the shape of the polyhedron. To erect the grid, the front face (the lid) is removed and, into each half of the open polyhedron, the absorptive and transparent grid layers are inserted as shown in FIGS. 15 and 16. FIG. 15 shows the use with the hexahedron previously described. FIG. 16 illustrates the fabrication method as it will be utilized with any polyhedral shape. The pressure plates and piston drives have been purposely enlarged for a better understanding. Using this method the front face need not be locked on, or even replaced for the piston to operate. In this aspect the drive mechanism, among others, can be a dualaction piston (pistons 41) as illustrated in FIGS. 15 and 16. A desirable dual piston drive for urging each piston away from the center is a reciprocating double rack such as that shown in FIG. 17. As seen in that figure the piston drive shafts are urged away from each other by racks 57 driven by spur gear 58. Each pressure plate 56 and 59 then compresses half of the multilayers inserted in the polyhedral case.

It can be seen that, by the invention herein, it is possible more readily to provide multilayer grids superior to those now available for detecting a spatial distribution of an energy ray source. Each multilayer grid is a regular polyhedron having faces transparent to photons of interest. The polyhedron is provided with two larger faces in the form of congruent polygons, and smaller faces in the form of polygons separating the two larger faces a predetermined distance equal to the width of the layers contained in the polyhedron. The polyhedron carries a piston in order to compress and retain the multilayers in place within the polyhedron. The larger faces are shaped so that formed multilayer grids will fit slidably within the grid openings in the grid trays. When inserted in the grid tray the grid can be used in an imaging instrument having a spatial structure with high resolving power for displaying an image of the energy ray source. The grid can be used in the detection of various energy rays, and it is particularly suitable for X-ray, gamma ray, and neutron imaging, for which no other effective imaging method exists.

Having been given the teachings of this invention ramifications and variations will occur to those skilled in the art. As an example the compression piston and the gearing housing can be removed prior to replacing the cover or front panel. However in our preferred embodiment the piston will be transparent to photons of interest, If the piston is formed of a material transparent to photons being observed it can be allowed to remain in the polyhedron when, as a grid, the polyhedron is placed in the grid tray. Similarly, the micrometer and piston drive, as well as the housing, can be made of a low-Z material so that they need not be removed As a variation, in the case of a hexahedron, unlike the other polyhedrons, the high-Z and low-Z layers can be inserted through any face. As another variation depth graded multilayers can be fabricated by the practice of this invention, As a still further ramification means can be provided for locking the piston in place after compression. In addition, in lieu of telescopes, the grids of the invention can be utilized in other spectroscopy and diffractometry instruments where energies of individual X-rays and neutron are to be measured with precision, for example, neutron imaging or therapy, spectrographic imagers, spectrometers, and diffractometers. Such modifications are deemed to be within the scope of this invention.

What is claimed is:

1. A multilayer grid containing alternate layers of an opaque or absorptive material and a transparent material for a neutron, hard X-ray, gamma-ray, imaging instrument containing a grid tray having openings to receive multilayer grids, the multilayer grid being a regular polyhedron having faces transparent to photons of interest, the polyhedron having two larger faces in the form of congruent polygons forming front and back surfaces of the polyhedron, remaining faces being smaller polygons separating the front and back surfaces a predetermined distance equal to the width of the two materials contained therein, the larger faces being shaped to form a multilayer grid fitting slidably within the grid opening in the grid tray, and the polyhedron containing a piston formed of a material transparent to photons of interest, which, through a drive shaft, compresses and retains the multilayers in place within the polyhedron, and which is allowed to remain in the polyhedron when, as a grid, the polyhedron is placed in the grid tray.

2. The multilayer grid of claim 1 wherein the parallelogram is an octagon.

3. The multilayer grid of claim 1 wherein the imaging instrument is a telescope, and the smaller polygons are parallelograms with perpendicular sides.

4. The multilayer grid of claim 2 wherein the piston drive shaft is coupled to a micrometer through a straight gear.

5. The multilayer grid of claim 2 wherein the piston drive shaft is coupled to a micrometer through a reciprocating double rack.

6. The multilayer grid of claim 2 wherein the polyhedron and the piston therein are made of glass.

7. The multilayer grid of claim 2 wherein the polyhedron and the piston therein are made of aluminum.

8. A method for improving a telescope used for neutron, hard X-ray and gamma-ray imaging, the telescope being one containing a grid tray having openings to receive multilayer grids, the improvement including assembling a regular polyhedron utilizing faces transparent to photons of interest, with two larger faces in the form of congruent polygons which form front and back surfaces of the polyhedron, and with smaller polygonal faces separating the front and back surfaces, the two larger faces being shaped to fit slidably within the grid opening in the grid tray, sizing a plurality of strips of absorptive and transparent materials so that their widths are equal to the width of the faces of the smaller polygons, inserting in the polyhedron, through an open face, alternate strips of the sized materials to form a multilayer, and compressing the multilayer to form a multilayer grid for insertion in the telescope grid tray.

9. The method of claim 8 wherein the uniform compressing of the inserted layers is accomplished by a piston sized to be inserted in the polyhedron through its open face, and contoured to fit slidably within the polyhedron.

10. The method of claim 9 wherein the piston is driven by a straight gear.

11. The method of claim 9 wherein the piston is driven by a reciprocating double rack.

12. The method of claim 9 wherein the piston is formed of a material transparent to photons of interest, and wherein it is allowed to remain in place within the polyhedron during use.

* * * * *